United States Patent [19]

Takasaki

[11] Patent Number: 4,508,377

[45] Date of Patent: Apr. 2, 1985

[54] DOOR HANDLE UNIT

[75] Inventor: Kunihiko Takasaki, Tokyo, Japan

[73] Assignee: Takigen Zeizous Co., Ltd., Tokyo, Japan

[21] Appl. No.: 475,867

[22] Filed: Mar. 16, 1983

[30] Foreign Application Priority Data

Apr. 8, 1982 [JP] Japan ..... 57-49897[U]

[51] Int. Cl.[3] ..... E05C 1/14

[52] U.S. Cl. ..... 292/166; 292/DIG. 65; 292/DIG. 71

[58] Field of Search ..... 292/166, 148, 153, 337, 292/113, DIG. 27, DIG. 65, DIG. 71

[56] References Cited

U.S. PATENT DOCUMENTS

| | | | |
|---|---|---|---|
| 2,718,421 | 9/1955 | Slopa et al. | 292/148 X |
| 3,494,650 | 2/1970 | Slopa | 292/166 X |
| 4,280,725 | 7/1981 | Berkawitz | 292/DIG. 71 X |

*Primary Examiner*—Richard E. Moore

*Attorney, Agent, or Firm*—Martin Smolowitz

[57] ABSTRACT

A door handle unit which comprises a unit body secured to a door, a lever type handle pivoted to the body by means of a main shaft mounted between upper and lower side walls of the body, a latch case fitted into the body from its rear side, a latch housed in the latch case so as to protrude and retreat from a left side wall of the body, a spring for urging the latch to slide leftward, a strike shaft mounted between the upper and lower side walls of the body, and two hook portions formed to project from the front portions of the latch case and opened rightward, in which those two right and left hook portions are engaged with the main shaft and the strike shaft respectively, and an actuating projection formed at the left end portion of the handle is brought into pressure-contact with the left side face of a receiving portion formed at the right end of the latch, thereby to urge the latch case to move rightward with respect to the body by virtue of the spring. This door handle unit can be simply and efficiently assembled just by fitting operations without a need of tightening screws.

8 Claims, 17 Drawing Figures

DOOR HANDLE UNIT

FIELD OF THE INVENTION

This invention relates to a handle unit mounted on a door of freezers, refrigerators, etc. and used for locking the door to fixed frame members such as a compartment body.

BACKGROUND OF THE INVENTION

In conventional door handle units, including a latch case which houses therein a latch coming into engagement with and disengagement from a keeper mounted on the fixed frame member side and a unit body to which is pivoted a handle for opening and closing the door, the latch case and the unit body are assembled in such a manner that the latch case is fitted in the unit body from its rear side and then outer peripheral portions of the latch case are secured to the unit body using screws.

However, with the assembling method using screws, many fixed positions are required to mount the latch case in stable condition without getting it out of order, because a so large force acts on the latch case when operated. This necessarily leads to an increase in the number of processes for machining the bore threaded holes in the unit body and for tightening operation of screws, thus resulting in unsatisfactory working efficiencies in both manufacturing and assembling the door handle units. Furthermore, a diameter and depth of the threaded holes must be selected larger in order to attain positive connections, whereby the associated parts including at least the latch case and the unit body are required to have a thickness appreciably increased. This avoids reduction in cost of materials and results in more weight of the entire handle unit.

SUMMARY OF THE INVENTION

It is an object of this invention to provide a door handle unit which allows constituent parts to be simply and efficiently manufactured and assembled and which permits reduction in weight of the entire unit as well as appreciable saving of materials.

The door handle unit according to this invention comprises; a unit body secured to a door; a lever type handle pivoted to the body by means of a main shaft mounted between upper and lower side walls of the body; a latch case fitted into the body from its rear side; a latch housed in the latch case so as to protrude and retreat from a left side wall of the body; a spring for urging the latch to slide leftward; a strike shaft mounted between the upper and lower side walls of the body; and hook portions formed to project from the front portions of the latch case and opened rightward, in which the hook portions are engaged with the main shaft and the strike shaft respectively, and an actuating projection formed at the left end portion of the handle is brought into pressure-contact with the left side face of a receiving portion formed at the rear end of the latch, thereby to urge the latch case to move rightward with respect to the body by action of the spring.

In the following, this invention will be described in detail with reference to the accompanying drawings which show a preferred embodiment of the invention.

DETAILED DESCRIPTION OF THE INVENTION

Figure 1:
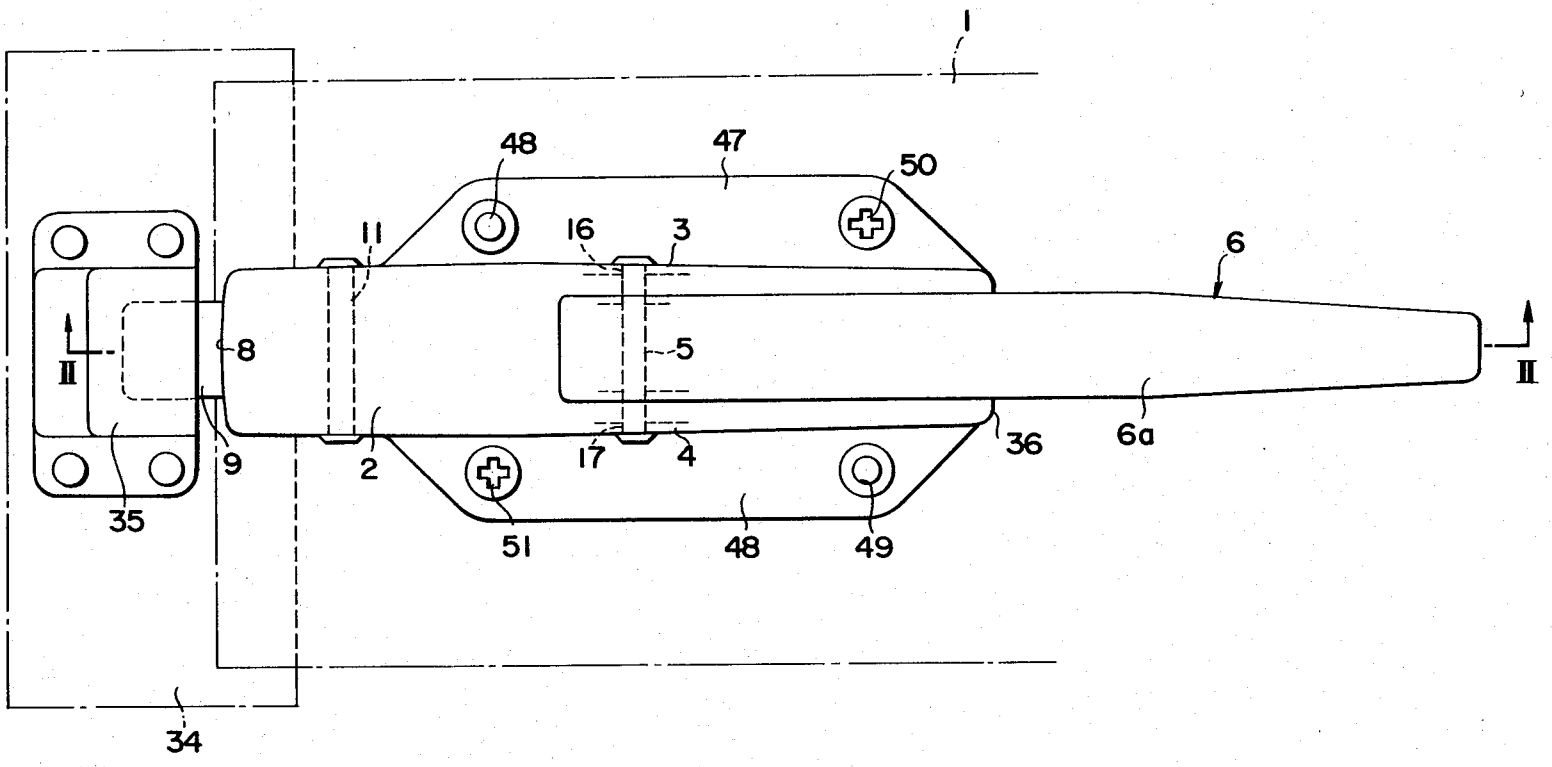
FIG. 1 is a front or top view of a door handle unit according to this invention in the locked state.
Figure 2:
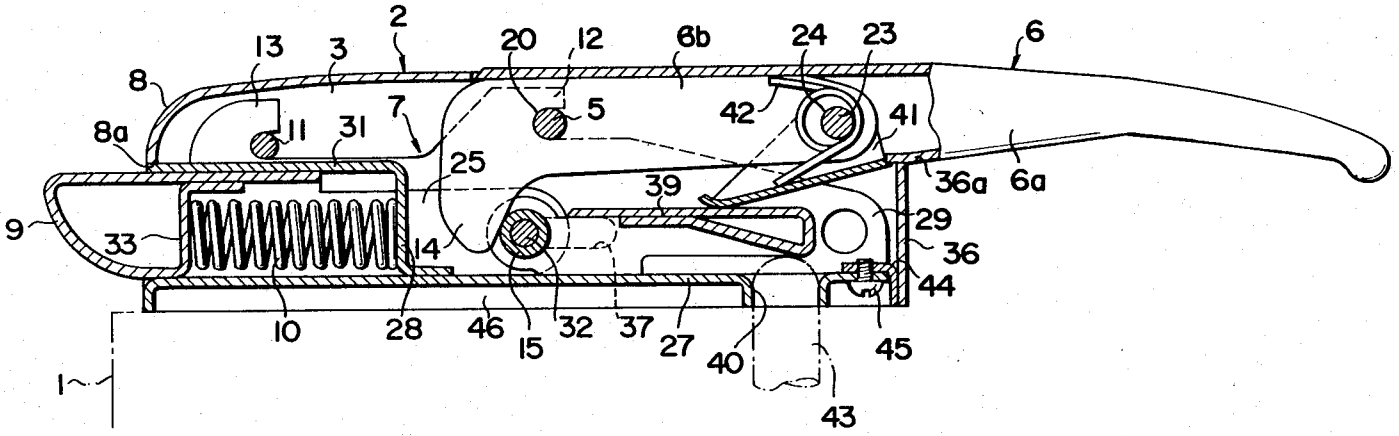
FIG. 2 is a sectional view of the handle unit taken along the line II—II in FIG. 1.
Figure 3:
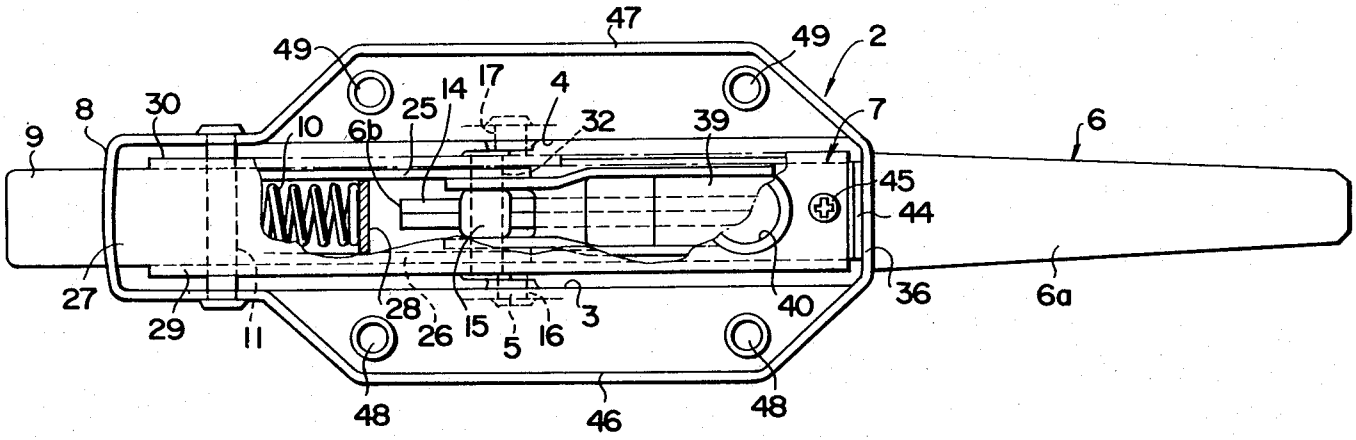
FIG. 3 is a rear view of the handle unit with a part being broken away.
Figure 4:
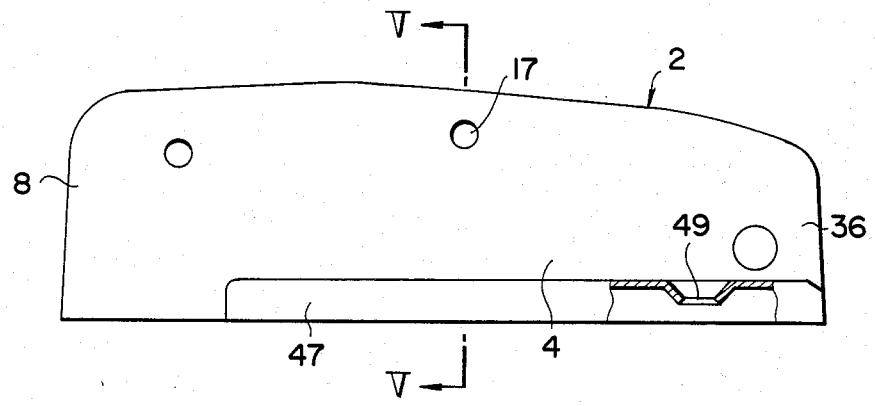
FIG. 4 is a side elevation view of a handle body.
Figure 5:
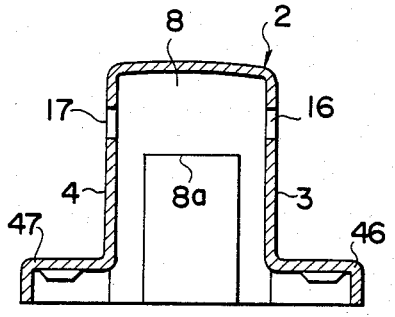
FIG. 5 is a sectional view taken along the line V—V of FIG. 4.
Figure 6:
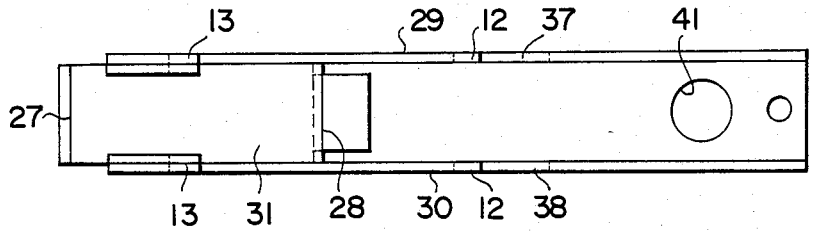
FIG. 6 is a front or top view of a latch case.
Figure 7:
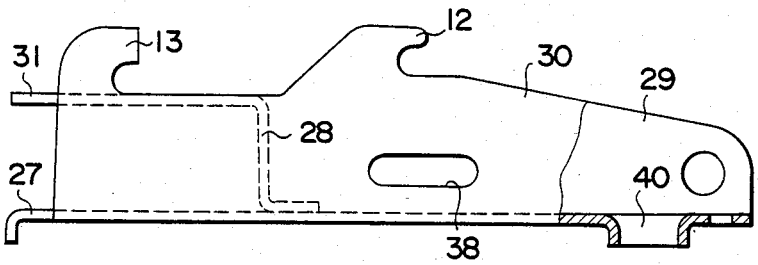
FIG. 7 is a bottom view of the latch case.
Figure 8:
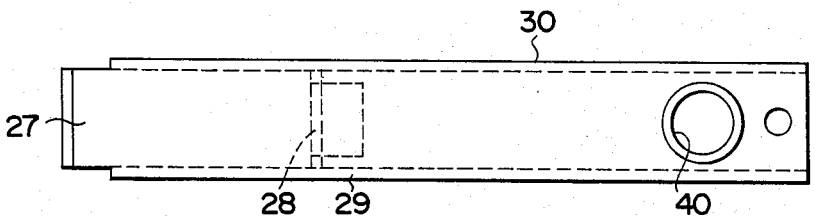
FIG. 8 is a rear view of the latch case.

As illustrated in FIGS. 1 to 3, a door handle unit comprises a unit body 2 secured to a door 1, a lever type handle 6 pivoted to the body 2 by means of a main shaft 5 mounted between upper and lower side walls 3 and 4 of the body 2, a latch case 7 fitted into the body 2 from its rear side, a latch 9 housed in the latch case 7 so as to protrude and retreat from a left side wall 8 of the body 2, a spring 10 for urging the latch 9 to slide leftward, a strike shaft 11 mounted between the upper and lower side walls 3 and 4 of the body 2, and hook portions 12, 13 formed to project from the front portions of the latch case 7 and opened rightward or in a rearward direction. When assembling, the hook portions 12 and 13 are engaged with the main shaft 5 and the strike shaft 11, respectively, and an actuating projection 14 formed at the left or front end portion of the handle 6 is brought into pressure-contact with the left side face of a receiving portion 15 formed at the rear end of the latch 9, thereby to urge the latch case 7 to move rightward with respect to the body 2 by virtue of the spring 10.

Figure 9:
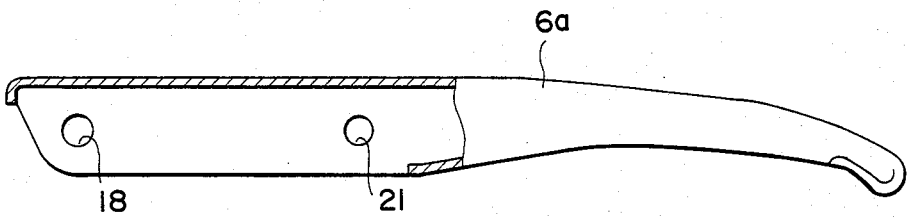
FIG. 9 is a bottom view of a handle body portion with a part being broken away.
Figure 10:
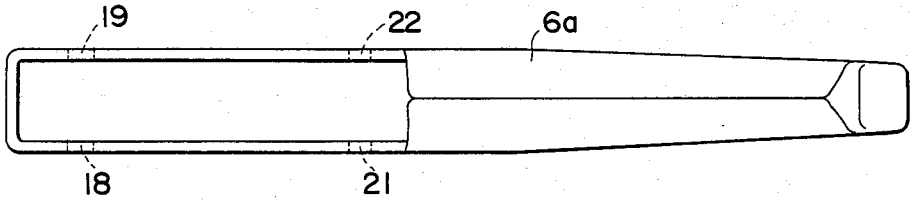
FIG. 10 is a rear view of the handle body portion.
Figure 11:
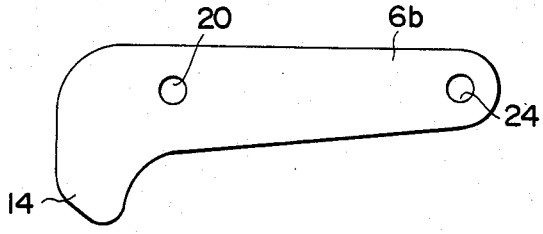
FIG. 11 is a bottom view of an actuating lever portion.
Figure 12:
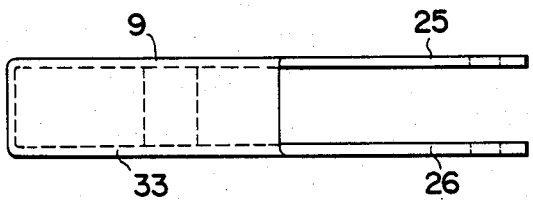
FIG. 12 is a front view of a latch.
Figure 13:
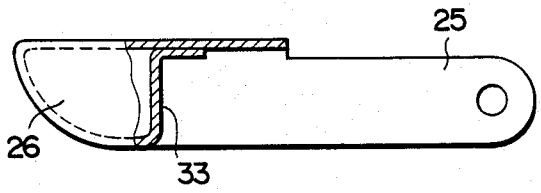
FIG. 13 is a bottom view of the latch.
Figure 14:
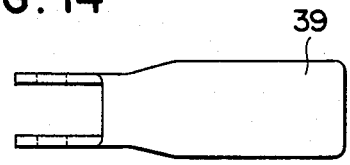
FIG. 14 is a front view of a cam shaft.
Figure 15:
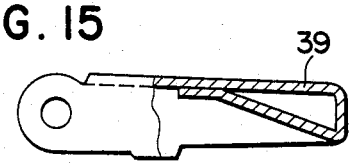
FIG. 15 is a bottom view of the cam shaft.
Figure 16:
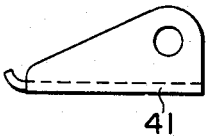
FIG. 16 is a bottom view of a reset lever.
Figure 17:
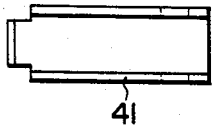
FIG. 17 is a front view of the reset lever.

In the illustrated embodiment, the handle 6 includes a body portion **6*a* which is gripped by the operator for locking or unlocking and closing or opening the door 1. The main shaft 5 having both ends fitted into through holes 16 and 17 formed in the upper and lower side walls 3 and 4 of the body 2, respectively, is inserted into through holes 18 and 19 at the left end portions of the upper and lower side walls of the body portion 6*a* and a through hole 20 in the actuating lever portion 6*b*, as illustrated in FIGS. 9–11. Also, a reset lever shaft 23 having both ends fitted into through holes 21 and 22 at the intermediate portions of the upper and lower side walls of the handle body portion 6*a* is inserted into a through hole 24 at the rear end portion of the actuating lever portion 6*b*. Thus, the actuating lever portion 6*b* moves integrally with the handle body portion 6*a*. The actuating lever portion 6*b* is composed of two combined plates and are located in between upper and lower side wall plates 25 and 26 of the latch 9, so that it does not suffer any restriction on its shape by the presence of the wall plates 25 and 26 and it may have a sufficiently large width. Therefore, the actuating lever portion 6*b*** has a greater structual strength, is subject to troubles of breakage or distorsion less often, and has a superior ruggedness compared with the conventional handle which includes a large notched portion near the main shaft by the presence of the latch portion and the plate portion for receiving a spring adapted to urge the latch.

A spring receiving plate 28 is projected from the front surface of a base portion 27 of the latch case 7, and the upper and lower side wall plates 25, 26 of the latch 9 are slidable in the left and right direction through spaces between the spring receiving plate 28 and an upper side wall plate 29 of the latch case and between the former plate 28 and a lower side wall plate 30 thereof. A latch guide plate portion 31 extends leftward continuously from the front end of the spring receiving plate 28 in parallel with the base portion 27, and the left end of the latch guide plate portion 31 comes into abutment with an inner end surface **8*a* of the left side wall 8 of the unit body 2. The receiving portion 15 of latch 9 is composed of a roller and its roller shaft 32 and are mounted between the upper and lower side wall plates 25 and 26 of the latch 9 at the right end portions thereof. The spring 10 for urging the latch consists of a compression coil spring which is pressedly fitted between the left side surface of the spring receiving plate 28 and a latch head 33. Thus, the handle 6 having the actuating projection 14 in pressure-contact with the left side face of the receiving portion roller 15 is urged to rotate about the main shaft 5 in the clockwise direction in FIG. 2 at all times. Therefore, when the latch 9 is engaged with a keeper 35 mounted on the side of a fixed frame member 34 such as a compartment body, i.e., in locked position, the rear central part of the handle body portion 6*a* is brought into pressure-contact with a front end surface 36*a* of a right side wall 36 of the body 2**.

Since the receiving portion roller 15 of the latch 9 has its left side face always in pressure-contact with the right side face of the actuating projection 14 of the handle and further because the handle 6 is mounted to the body 2 through the main shaft 5 and fixed in its position, as previously noted, the latch case 7 is urged to move rightward by the repulsion of the spring 10 for urging the latch at all times, of course including the state where the latch is in locked position. Thus, the hook portions 12 and 13 projected from the front edges of the upper and lower side wall plates 29 and 30 of the latch case 7, respectively, are positively held in the respective engaged states with the the main shaft 5 and strike shaft 11. In this embodiment, the latch case 7 fixedly fitted into the body 2 as mentioned above is secured to a receiving plate 44 fixed onto the inner surface of the right side wall 36 of the body 2 by means of a screw 45 in such a state that the right end of the base portion 27 abutes against the rear surface of the receiving plate 44. The thus constructed handle unit is secured to the door by inserting clamping bolts 50, 51 into through holes 48, 49 formed in upper and lower wing portions 46, 47 of the body 2, and in this state the latch case 7 is brought into abutment against the outer surface of the door 1.

The roller shaft 32 is movable leftward and rightward within elongated holes 37 and 38 formed in the intermediate portions of the upper and lower side wall plates 29 and 30 of the latch case 7, respectively. A cam lever 39 is pivoted to the right end portion of the latch 9 through the roller shaft 32 and it has its right end portion facing a through hole 40 which is formed in the base plate portion 27 of the latch case 7. Also, a reset lever 41 is pivoted to the handle 6 through the reset lever shaft 23 and it comes into pressure-contact with the cam lever 39 by virtue of a torsion coil spring 42. In this arrangement, when a safety pushing rod 43 is fitted into the through hole 40 is operated from within the compartment, both cam lever 39 and reset lever 41 are pushed outward, thus allowing the handle 6 to turn in the unlocking direction. Thus, even if any person is imprisoned within the compartment, he can get away by himself by pushing the rod 43.

According to the door handle unit of this invention, as fully described in the above, the main shaft 5 is mounted between the upper and lower side walls 3, 4 of the body 2 secured to the door 1, the lever type handle 6 pivoted to the body 2 through the main shaft 5 has an actuating projection 14 at its left end portion, the latch 9 is housed in the latch case 7 fitted into the body 2 from its rear side, the latch 9 is urged to slide leftward by virtue of the spring 10, the hook portions 12 and 13 projecting from the front portions of the latch case 7 and opened rightward are respectively engaged with the main shaft 5 and the strike shaft 11 mounted between the upper and lower side walls 3 and 4 of the body 2, and the actuating projection 14 formed at the left end portion of the handle 6 is brought into pressure-contact with the left side face of the receiving portion 15 formed at the right end of the latch, thereby to urge the latch case 7 to move rightward with respect to the body 2 by virtue of the spring 10. Thus, the latch case 7 can be mounted and fixed onto the body 2 just by very simple fitting and locking operations.

As a result, the number of processes for machining to bore threaded holes in the latch case 7 and the body 2 and for tightening operation of screws is minimized, and hence working efficiencies in both manufacturing and assembling can be improved correspondingly. Furthermore, there is no need of boring threaded holes in both latch case 7 and body 2 which holes are used for connecting therebetween, so that those members are not required to have a large thickness. That is, the thickness of the body 2 and the latch case 7 can be reduced significantly. This results in saving of materials used and permits reduction in weight of the door unit with ease.

What is claimed is:

1. A door handle unit comprising:

a unit body to be secured to a door;

a lever type handle pivoted to said body by means of a main shaft mounted between upper and lower side walls of said body;

a latch case fitted into said body from its rear side;

a latch housed in said latch case so as to protrude and retreat from a left side wall of said body;

a spring pressedly fitted between a receiving plate and a latch head portion of said latch case, for urging said latch to slide leftward relative to said latch case;

a strike shaft mounted between the upper and lower side walls of said body;

hook portions formed to project from the front portions of said latch case and opened rightward, in which said hook portions are engaged with said main shaft and said strike shaft respectively;

and an actuating projection formed at the left end portion of said handle which is brought into pressure-contact with the left side face of a receiving portion formed at the right end of said latch, thereby to urge said latch case to move rightward with respect to said body and said spring.

2. A door handle unit according to claim 1, wherein said spring consists of a coil compression spring.

3. A door handle unit according to claim 1, wherein said receiving portion of said latch includes a roller shaft and a roller mounted on the roller shaft for contact with the actuating portion.

4. A door handle unit according to claim 1, wherein said spring is pressedly fitted between said spring receiver plate formed at said latch case on the front side of an actuating projection and a latch head formed at the front end portion of said latch.

5. A door handle unit according to claim 1, wherein said latch case contains a hole in its lower surface and a cam lever pivoted to the right end portion of said latch, whereby said cam lever can be contacted by a rod extending through said hole in the latch case and which may be actuated by a push for moving said latch rightward.

6. A door handle unit according to claim 5, wherein a spring actuated reset lever is provided pivoted to the handle in pressure contact with said cam lever, whereby the cam lever is reset when the pushing rod is retracted.

7. A door handle unit according to claim 1, wherein said unit is secured to a door by clamping bolts provided through said unit body.

8. A door handle unit, comprising:

a unit body to be secured to a door;

a lever type handle pivoted to said body by means of a main shaft mounted between upper and lower side walls of said body;

a strike shaft mounted between the upper and lower side walls of said body;

a latch case fitted into said body from its rear side and containing a hole in its lower surface, said latch case having hook portions formed to project from the front portions of the latch case and opened rightward, so that said hook portions are engaged with said main shaft and said strike shaft respectively;

a latch including a receiving portion housed in said latch case, so as to protrude and retreat from a left side wall of said body, said latch having a cam lever pivoted to one end;

a compression spring pressedly fitted between a receiving plate and a latch head portion of said latch case for urging said latch to slide leftward; and an actuating projection formed at the left end portion of said handle which is brought into pressure-contact with the left side face of a receiving portion formed at the right end of said latch, thereby urging said latch case to move rightward with respect to said body and said spring.

* * * * *